United States Patent [19]

Hennings et al.

[11] Patent Number: 4,478,147

[45] Date of Patent: Oct. 23, 1984

[54] TRI-ROTOR SAFE AND ARM DEVICE

[75] Inventors: George N. Hennings; Larry F. Brauer; Richmond H. Nickles, all of Ridgecrest, Calif.

[73] Assignee: The United States of America as represented by the Secretary of the Navy, Washington, D.C.

[21] Appl. No.: 463,178

[22] Filed: Feb. 3, 1983

[51] Int. Cl.[3] ..... F42C 15/00; F42C 9/00; F42C 15/40

[52] U.S. Cl. ..... 102/255; 102/238; 102/264

[58] Field of Search ..... 102/262, 264, 254, 255, 102/276, 248, 238, 232, 222, 221

[56] References Cited

U.S. PATENT DOCUMENTS

| | | | |
|---|---|---|---|
| 2,789,508 | 4/1957 | Rove et al. | 102/255 |
| 2,805,623 | 9/1957 | Blair et al. | 102/226 |
| 2,839,998 | 6/1958 | Rabinow et al. | 102/226 |
| 3,306,207 | 2/1967 | Becker et al. | 102/254 |
| 3,583,319 | 6/1971 | James | 102/238 |
| 3,614,930 | 10/1971 | Brackman et al. | 102/255 |
| 3,670,656 | 6/1972 | Donahue et al. | 102/228 |
| 3,972,290 | 8/1976 | Czajkowski et al. | 102/238 |
| 4,015,532 | 4/1977 | Morrow | 102/238 X |
| 4,036,144 | 7/1977 | Meek | 102/254 |
| 4,154,169 | 5/1979 | Petiteau | 102/233 |
| 4,240,351 | 12/1980 | San Miguel | 102/254 X |
| 4,278,026 | 7/1981 | Hibbs et al. | 102/254 |
| 4,418,621 | 12/1983 | Rosselet | 102/244 X |

FOREIGN PATENT DOCUMENTS

| | | | |
|---|---|---|---|
| 397451 | 11/1931 | United Kingdom | 102/238 |

*Primary Examiner*—David H. Brown

*Attorney, Agent, or Firm*—Robert F. Beers; W. Thom Skeer; Thomas W. Hennen

[57] ABSTRACT

A safety arming device driven by a reversible motor including a detonator positioned in a casing for initiating explosive logic through the reception of signals from an electric circuit. A driver wheel is rotated by the reversible motor which matingly engages a driven wheel. The driven wheel includes a groove into which a guide pin from the driver wheel moves and the driver wheel rotates through a predetermined angle to align detent slots at a latching position. There is provided an output wheel having gear teeth and explosive output leads, and upon the alignment of the slots in the latching position, the latching mechanism engages the driver/-driven wheels, and upon further rotation the wheels are enmeshed to rotate the explosive output lead to an alignment position with the detonator.

9 Claims, 11 Drawing Figures

TRI-ROTOR SAFE AND ARM DEVICE

BACKGROUND OF THE INVENTION

1. Field of the Invention

This invention relates to the field of electro mechanics. More particularly, this invention relates to the field of safe and arm devices. Still more particularly, but without limitation thereto, this invention relates to the field of electro-mechanical safe and arm devices for detonating a booster in a bomb.

2. Description of the Prior Art

One of the most critical elements in conventional ordnance is the safe and arm device (S-A). The primary function of the S-A is to maintain the weapon in a safe condition until an arming signal is received. Upon receipt of the arming signal, the S-A transforms the weapon from a safe condition into an armed condition where the main explosive charge may be detonated.

These functions are normally performed by controlling the alignment of the sensitive explosive components of the warhead initiation system. In the safe position the primary initiation explosives are misaligned with the booster/warhead explosives, preventing detonation prior to arming. Arming is started when the fuze receives a unique set of inputs indicating release from the aircraft. Upon obtaining a safe separation distance or time, the initiation explosives are aligned with the booster/warhead explosives. In this position, initiation of the sensitive explosives will cause the warhead to detonate. Initiation in the safe condition will result in a dud weapon with no booster/warhead detonation.

Current bomb S-A devices are marginal in meeting both the safety and arming requirements. The safety failures experienced have resulted in many bomb fuzes being removed from active service as a result of loss of both aircraft and personnel. Arming failures and inability to survive impact in the armed condition have resulted in a low weapon reliability and high dud rate. The net result is a low weapon effectiveness and a high risk of usage for bombs.

Current bomb fuze safe and arm (S-A) devices utilize either mechanical escapements or electronic timers to provide safe separation arming time delays. Also, many of the S-A designs employ stored energy, such as bellows motors, to arm the fuze. These techniques have proven to present safety harzards and yield low reliability in previous bomb fuzes.

The use of mechanical escapements as a safe-arm time delay is undesirable for two major reasons. First, the escapement mechanism technology is rapidly disappearing with the advent of the digital watch technology, resulting in a sharp decrease in manufacturing capabilities coupled with a rise in costs. Second, the flexibility of mechanical timers is poor, resulting in a high cost for arming time options with relatively poor timing accuracy. The advantage in using a mechanical interlock is that it provides a high degree of safety unless the escapement goes into a "runaway" condition and functions improperly.

In contrast to the mechanical escapement, the electronic timer can provide a very accurate reference time. Unfortunately electronic timers do not provide a mechanical interlock and have failure modes which allow instantaneous arming.

Another problem is experienced when existing designs are used with moderate or hard target penetrators. Upon impact the high accelerations tend to either destroy the S-A mechanism or cause misalignment of the explosive output. This results in low reliability with the bomb/fuze combination being unsatisfactory.

SUMMARY OF THE INVENTION

An object of this invention is to provide a bomb safe and arm device that is recyclable, provides a timing function, and incorporates mechanical logic.

A further object of this invention is to provide a bomb safe and arm device that is operable in conjunction with electronic fuzing functions to provide mechanical logic and timing functions, preventing arming if the fuze electronics fails.

These and further objects have been demonstrated according to the present invention wherein the safe and arm device is driven by a reversible motor and includes a detonator positioned in a casing for initiating explosive logic through the reception of signals from an electronic circuit. A driver wheel is rotated by the reversible motor which matingly engages a driven wheel. The driven wheel includes a groove into which a guide pin from the driver wheel moves and the driver wheel rotates through a predetermined angle to align detent slots at a latching position. There is provided an output wheel having gear teeth and explosive output leads, and upon the alignment of the slots in the latching position, the latching mechanism engages the driver/driven wheels, and upon further rotation the wheels are enmeshed to rotate the explosive output lead to an alignment position with the detonator.

BRIEF DESCRIPTION OF THE DRAWINGS

Illustrative examples of the present invention are illustrated in the accompanying drawings wherein.

DESCRIPTION OF THE PREFERRED EMBODIMENT

Figure 1A:
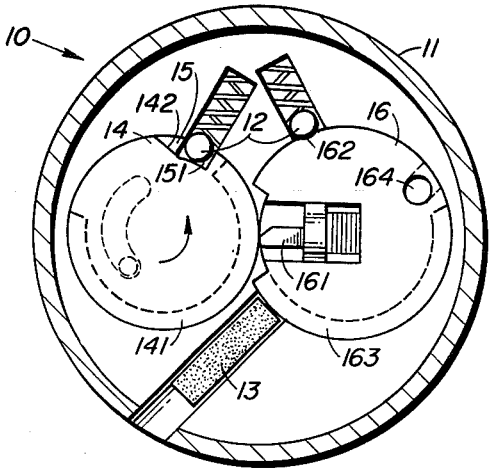
FIG. 1 is a series of illustrative cut-away plan views of the safe and arm mechanism of the invention in various functional positions, A, safe position; B, driven wheel in position; C, driver wheel in position; D, engagement of mating spur gears; E, rotation to armed position; F, rotation back to disengagement; and, G, rotate back to safe return position.

Referring to FIGS. 1A to 1G, S-A 10 is composed of a casing 11, detents 12, a detonator 13, a driver wheel 14, a driven wheel 15, only partially shown, and an explosive output wheel 16. Various bearings and shafts are within casing 11 and are described below. A reversible motor 18, FIG. 2, below, is attached to driver wheel 14. The motor 18 is controlled by an external electrical circuit with associated logic. A separate detent 12 is provided for each of wheels 14, 15, and 16 but for the sake of simplicity are only shown in FIGS. 1A and 3.

Driver wheel 14 rotates clockwise (CW) or counterclockwise (CCW) a given angular displacement and is composed of gear teeth 141 located partially about its circumference, represented in the drawing by a dashed line along the geear root line, and angled detent slot 142, and a guide pin 143 which engages driven wheel 15.

Driven wheel 15, located directly behind driver wheel 14, is free to move independently of the other wheels except when urged by the pin 143 of driver wheel 14, or spur gear teeth 163, of output wheel 16. Driven wheel 15 is composed of gear teeth 154 located partially around its circumference, a rectangular detent slot 151, and a groove 152 into which the guide pin 143 travels.

Output wheel 16 is composed of latch 161, a detent slot 162, spur gear teeth 163 located partially around its circumference, and an explosive output lead 164.

Figure 2:
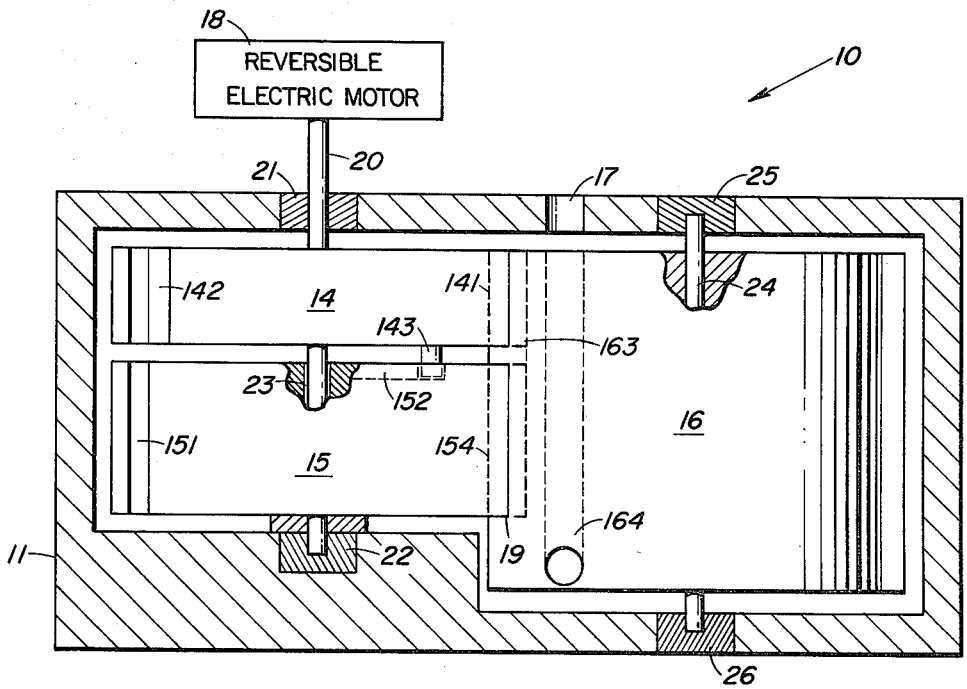
FIG. 2 is a cut-away elevation view of the S-A device of the present invention in the position of FIG. 1E.

Referring to FIG. 2, drive shaft 20 of S-A device 10 is supported for rotation by upper drive bearing 21 and lower drive bearing 22 in casing 11. Driver wheel 14 is mounted on drive shaft 20 and rotates therewith. Driven wheel 15 is mounted on drive shaft 20 by means of free wheel bearing 23 and is free to rotate on shaft 20. Guide pin 143 is mounted upon driver wheel 14 and runs in groove 152. Guide pin 143 and groove 152 comprise first and second lateral means for engaging and serve to transmit intermittent motion directly from driver wheel 14 to driven wheel 15. Output wheel 16 is mounted for rotation on shaft 24 in casing 11 by means of upper output bearing 25 and lower output bearing 26. Spur gear teeth 163 of output wheel 16 interlock respectively with driver wheel gear teeth 141 and driven wheel gear teeth 154. Explosive output lead 164 aligns with casing output lead 17 and detonator 13 in the armed position as shown. Reversible electric motor 18 drives drive shaft 20.

Figure 3:
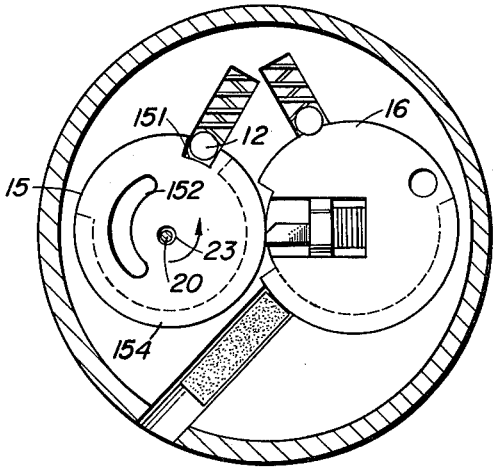
FIG. 3 is a plan view similar to that of FIG. 1A but with driver wheel removed to better illustrate the driven wheel of the present invention.

Referring to FIG. 3 driven wheel 15 is more clearly illustrated with rectangular detent slot 151 and groove 152. Groove 152 extends partially around the wheel 15 and allows for placement of wheel 15 in aligned position by means of guide pin 143 (see FIGS. 1A to 1G) rotating in one direction followed by reversal of rotation of guide pin 143 whereby pin 143 travels in groove 152 thus allowing driver wheel 14 to be properly aligned while leaving driven wheel 15 in the desired aligned position. A detent 12 holds driven wheel 15 at rectangular slot 151 while in the safe position of FIG. 1A.

Figure 4A:
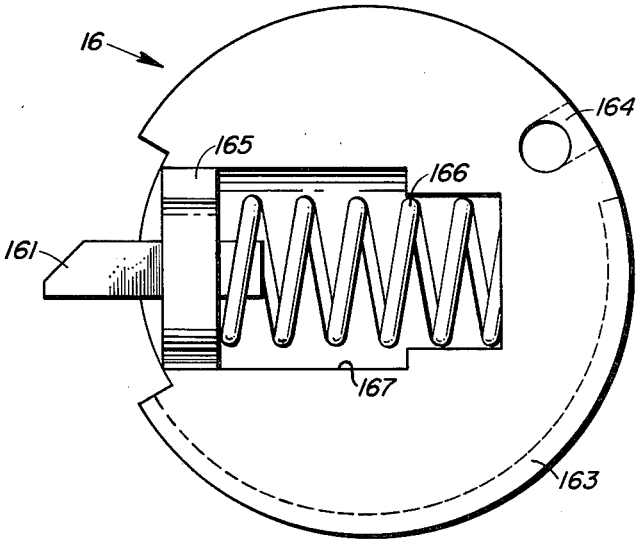
FIG. 4A and FIG. 4B are respective axial cut-away and radial views of the output wheel and latch of the present invention.
Figure 4B:
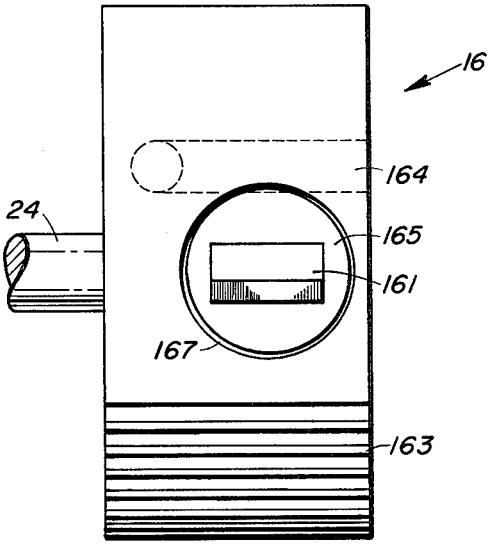

Referring to FIGS. 4A and 4B, output wheel 16 encloses latch 161, having base 165, and spring 166 slidably mounted in bore 167. Latch 161 is shaped so as to engage detent slots 142 and 151 of driver wheel 14 and driven wheel 15, respectively.

Basically, driver wheel 14, through various rotary motions moving through defined angles, causes driven wheel detent slot 151 to come into alignment with detent slot 142 of driver wheel 14 so that latch 161 engages both slots. Further rotation of driver wheel 14 causes output wheel 16 to engage its spur gear teeth 163 with spur gear teeth 141 of driver wheel 14 and spur gear teeth 154 of driven wheel 15. Further rotation causes output wheel 16 to stop in an armed position wherein explosive lead 164 is aligned with detonator 13. Upon electronic signals from the S-A associated electronics, detonator 13 explodes causing explosive lead 164 to explode thereby detonating a booster, not shown.

In greater detail, FIG. 1A shows S-A device 10 in a safe position with detents 12 engaged in detent slots 142, 151, and 162. Explosive lead 164 is not aligned with detonator 13.

Figure 1B:
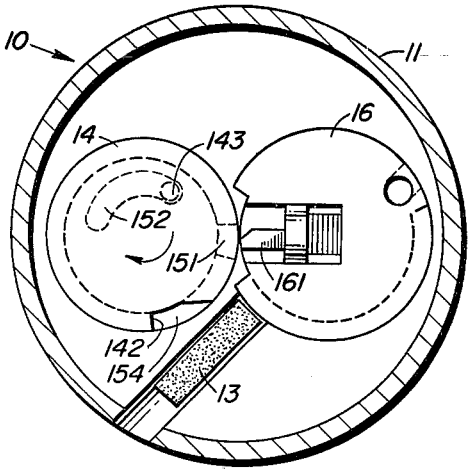

By rotating driver wheel 14 clockwise, as in FIG. 1B, detent slot 151 is also rotated clockwise to stop at the position shown; latch 161 can not engage because detent slot 142 must also be aligned.

Figure 1C:
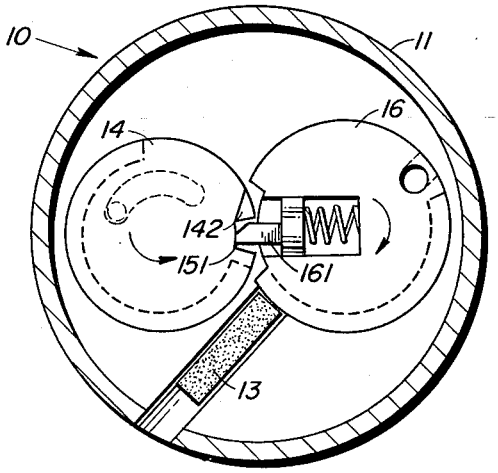

By a counterclockwise rotation, driver wheel 14, as in FIG. 1C, moves its detent slot 142 into alignment with detent slot 151 and latch 161. Latch 161 then engages both detent slots. No spur gears have engaged so far because latch 161 was not engaged during the previous rotations.

Figure 1D:
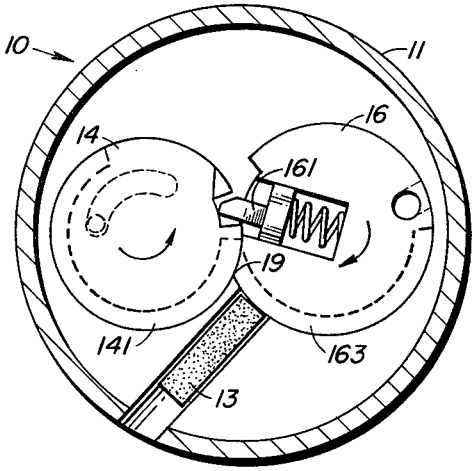
Figure 1E:
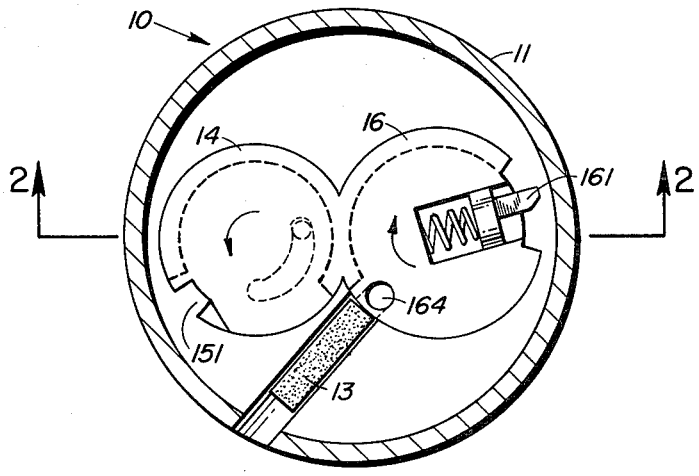

As seen in FIG. 1D, driver wheel 14 turns counterclockwise. Because latch 161 is engaged now, output wheel 16 turns clockwise. But as this happens latch 161 comes out of engagement and spur gears of driver wheel 14, driven wheel 15, and output wheel 16 engage at point 19. Further rotation of driver wheel 14 causes explosive output lead 164, as in FIG. 1E, to align with detonator 13. Now the S-A is in the armed position.

Figure 1F:
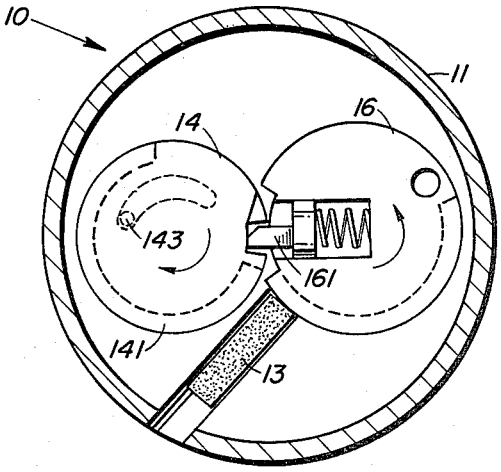
Figure 1G:
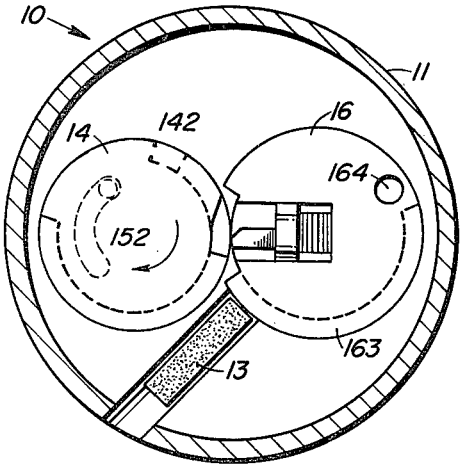

FIGS. 1F and 1G illustrate the procedure of returning the S-A 10 from the armed position to the safe return position. The S-A may be rotated from the armed to the safe position by clockwise rotation of driver wheel 14 to the position as in FIG. 1F. Angled detent slot 142 acts as a cam once the commit to arm position is again reached thus displacing latch 161 from the engaged position allowing further clockwise rotation of both driver wheel 14 and, by way of guide pin 143 and groove 152, driven wheel 15 to the safe return position, FIG. 1G. Driver wheel 14 then is rotated counterclockwise so that slot 142 engages detent 12 in the safe position as in FIG. 1A.

The specific electronic logic and hardware necessary for providing control inputs to the reversible electric motor 18 and detonator 13 are conventional in the art and form no part of the invention.

The various components of S-A 10 can be constructed of any suitable material such as plastic or stainless steel. The explosive output lead material may be any material suitable for use in fuze explosive lead trains. Although a single driven wheel is described, any desired number of wheels may be employed and proper corresponding electronic logic provided to the reversible motor.

It will be apparent that the embodiments shown are only exemplary and that various modifications can be made in construction and arrangement within the scope of the invention as defined in the appended claims.

We claim:

1. A safe and arm device for use in an ordnance item having means for generating control and detonation signals, said safe and arm device comprising:

a casing;

a detonator mounted in said casing and responsive to an external detonation signal;

an output wheel mounted in said casing for rotation about a first axis between safe and armed positions, and having an explosive output lead having first and second ends, a first peripheral means for engaging, means for latching, and a first detent slot;

a first detent mounted in said casing and positioned for selective engagement of said first detent slot in said output wheel thereby defining said safe position of said output wheel, said safe position of said output wheel being further defined by said first end of said explosive output lead being spaced from said detonator;

a driven wheel mounted in said casing for rotation about a second axis parallel with and spaced from said first axis, said second axis being located to intersect a line which intersects said first axis and passes through said means for latching if said output wheel is in said safe position, said driven wheel having second peripheral means for engaging selectively positionable for engagement with said first peripheral means for engaging, first lateral means for engaging, and a second detent slot located adjacent said second peripheral means for engaging for selectively receiving said means for latching;

a second detent mounted in said casing and positioned for selective engagement with said second detent slot in said driven wheel, thereby defining a safe position of said driven wheel;

a driver wheel mounted in said casing for coaxial rotation with said driven wheel, said driver wheel having third peripheral means for engaging positionable for engagement with said first peripheral means for engaging, second lateral means for engaging coacting with said first lateral means for engaging to intermittently transfer rotational motion from said driver wheel to said driven wheel, and a third detent slot located adjacent said third peripheral means for engaging for selectively receiving said means for latching;

a third detent mounted in said casing and positioned for selective engagement of said third detent slot in said driver wheel thereby defining a safe position of said driver wheel; and a reversible driver attached to said driver wheel, said reversible driver imparting rotation to said driver wheel in response to an external control signal;

said safe position of said output wheel being further defined by said first peripheral means for engaging being positioned out of engagement with said second and third peripheral means for engaging and said means for latching being out of engagement with said second and third detent slots; and said armed position of said output wheel being defined by said first end of said explosive output lead being positioned adjacent said detonator, said means for latching being positioned away from said second axis, and said first peripheral means for engaging being positioned in engagement with said second and third peripheral means for engaging.

2. A safe and arm device as set forth in claim 1 wherein said third detent slot includes a first side that is substantially radial with respect to the center of said driver wheel, and a second side that slopes away from said first side to thereby provide a camming surface for selective interaction with said third detent and said means for latching.

3. A safe and arm device as set forth in claim 1 wherein said first and second lateral means for engaging comprise:

said driven wheel defining an arcuate slot concentric about the center of said driven wheel; and a guide pin attached to said driver wheel and extending into said arcuate slot.

4. A safe and arm device as set forth in claim 1 wherein said first, second and third detents each comprise:

said casing defining a cavity;

a ball slidably disposed in said cavity; and a spring disposed in said cavity and bearing on one end against said casing and on the other end against said ball.

5. A safe and arm device as set forth in claim 1 wherein said first, second and third peripheral means for engaging comprise integral spur gear teeth disposed upon a portion of the peripheral surface of said output wheel, driven wheel and driver wheel, respectively.

6. A safe and arm device as set forth in claim 1 further comprising said casing defining a passageway positioned for alignment with said second end of said explosive output lead if said output wheel is in said armed position, for transferring explosive output from said explosive output lead to the exterior of said casing.

7. A safe and arm device as set forth in claim 1 wherein said reversible drive comprises a reversible electric motor.

8. A safe and arm device as set forth in claim 1 wherein said means for latching comprises:

said output wheel defining a bore open on one end and aligned radially with respect to the center of said output wheel;

a base slidably disposed within said bore;

a spring disposed radially in said bore and bearing on one end against said output wheel and on the other end against said base; and a latch attached to said base and extending radially out of said bore.

9. A safe and arm device as set forth in claim 8 further comprising said output wheel defining a peripheral recess colocated with said means for latching, and said latch resiliently bearing on the peripheries of said driver wheel and said driven wheel in said safe positions of said output wheel, driven wheel and driver wheel, respectively.

* * * * *